United States Patent [19]

Kallin et al.

[11] Patent Number: 4,681,468

[45] Date of Patent: Jul. 21, 1987

[54] THERMAL PRINTING APPARATUS

[75] Inventors: Fredrik L. N. Kallin, Kitchener; Edward R. Evans, St. Clements, both of Canada

[73] Assignee: NCR Corporation, Dayton, Ohio

[21] Appl. No.: 452,858

[22] Filed: Dec. 23, 1982

[51] Int. Cl.[4] ..... B41J 11/26

[52] U.S. Cl. ..... 400/120; 400/613.2; 400/615.1

[58] Field of Search ..... 400/120, 119, 613, 613.2, 400/613.4, 615.1

[56] References Cited

U.S. PATENT DOCUMENTS

| | | | |
|---|---|---|---|
| 2,306,616 | 12/1942 | Copeland | 400/613.2 X |
| 2,534,391 | 12/1950 | Von Duyke | 400/613.2 |
| 2,973,081 | 2/1961 | Maidment et al. | 400/613.2 |
| 3,939,956 | 2/1976 | Stamov | 400/613.2 X |
| 4,107,700 | 8/1978 | Jornod | 400/613.2 X |
| 4,141,660 | 2/1979 | Bommersheim et al. | 400/613.2 X |
| 4,252,453 | 2/1981 | Estabrooks | 400/613.2 X |

FOREIGN PATENT DOCUMENTS

| | | | |
|---|---|---|---|
| 2847583 | 5/1980 | Fed. Rep. of Germany | 400/613.2 |
| 2007022 | 1/1970 | France | 400/613.2 |
| 90388 | 7/1980 | Japan | 400/613.2 |
| 11072 | 1/1982 | Japan | 400/613.2 |

*Primary Examiner*—E. H. Eickholt

*Attorney, Agent, or Firm*—Albert L. Sessler, Jr.; Elmer Wargo

[57] ABSTRACT

A printing apparatus including a support body and a printer. The support body has a first area for storing media to be supplied to the printer, and a second area for receiving media from the printer which is mounted on the support body. The support body has a linkage mechanism to enable the support body to be moved from a home position to an accessing position where the accessing of media in the support body is facilitated.

12 Claims, 10 Drawing Figures

THERMAL PRINTING APPARATUS

BACKGROUND OF THE INVENTION

This invention relates to a printing apparatus, which in the embodiment described, relates to a printer which is incorporated in a support body which is movable between an operative or home position and an accessing position from which the accessing of printing media and easy maintenance of the printer can be effected.

The particular environment selected to portray this invention relates generally to business equipment, and more particularly, it relates to a journal printer, for example. Very generally, a journal printer is an apparatus which reads data on documents such as checks and prints the data read or entries on a medium such as a journal tape to provide a permanent record of the entries in much the same manner as does an "adding machine tape".

Some of the problems associated with prior art, journal printers are that:

1. Some are slow in speed.
2. Some are very noisy because they utilize solenoid actuators in the associated printers.
3. The solenoid actuators mentioned have a high failure rate requiring excessive down time of the journal printer.
4. Some of the printers are so integrally formed as a part of the business machine itself that again, excessive down time for the business machine results when repair to the associated printer is required.

SUMMARY OF THE INVENTION

The printing apparatus of this invention comprises: a support body; a printer; said support body having a first area for storing media to be supplied to said printer and a second area for receiving media from said printer, mounting means for mounting said printer on said support body to enable said printer to be moved as a unit with said support body; and moving means coupled to said support body to enable said support body to be moved from a home position to a second position where the accessing of media in said body is facilitated.

The advantages of this invention are as follows:

1. The printing apparatus is designed to be replaced very quickly to minimize down time of the associated business machine.
2. The printing apparatus is quiet in operation, low in cost, and permits visibility of the last line printed.
3. The printing apparatus facilitates the loading and unloading of media while an operator sits at the front of the machine in which the printing apparatus is incorporated.
4. The printing apparatus can be loaded with either fanfold paper or roll paper.

These advantages and others will be more readily understood in connection with the following specifications, claims, and drawing.

BRIEF DESCRIPTION OF THE DRAWING

FIG. 6-1 is a cross-sectional view, taken along the line 6-1—6-1 of FIG. 6 to show a cam and the print head in a paper-insertion position;

FIG. 6-2 is a view similar to FIG. 6-1 to show the cam and print head in the normal, printing position;

DETAILED DESCRIPTION OF THE INVENTION

Figure 1:
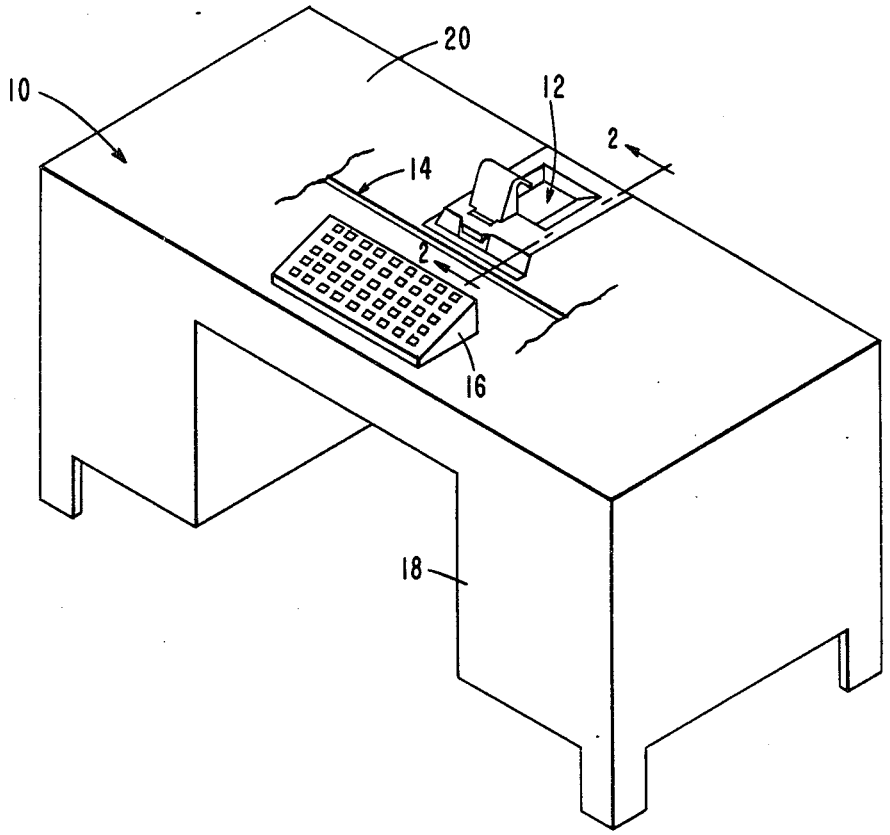
FIG. 1 is a general view, in perspective, of a business machine in which the printing apparatus of this invention may be incorporated.

FIG. 1 is a general view, in perspective, of a portion of a business machine 10 in which the printing apparatus 12 of this invention may be incorporated.

The machine 10 may have a document track 14 along which documents are fed to be read by a reader (not shown), and thereafter, the data read is printed on a "journal tape" by the printing apparatus 12. An operator sits at the machine 10 and controls it, conventionally, via a keyboard 16. The machine 10 has a frame 18, having a top or reference plane 20. The keyboard 16 is located at the front of the machine 10, while the printing apparatus 12 is located towards the rear of the machine from the operator's viewpoint. In prior art journal printers, for example, the operator has to move from the sitting or operating position at the front of the machine and walk around to the rear of the machine in order to add or remove paper from the printing apparatus. The printing apparatus 12 enables an operator to load and unload the associated paper while being seated at the front of the machine 10; this aspect will be described hereinafter. Only those portions of machine 10 which are related to this invention are shown in FIG. 1 to simplify the drawings; however, the balance of the machine (not shown) may be conventional.

Figure 2:
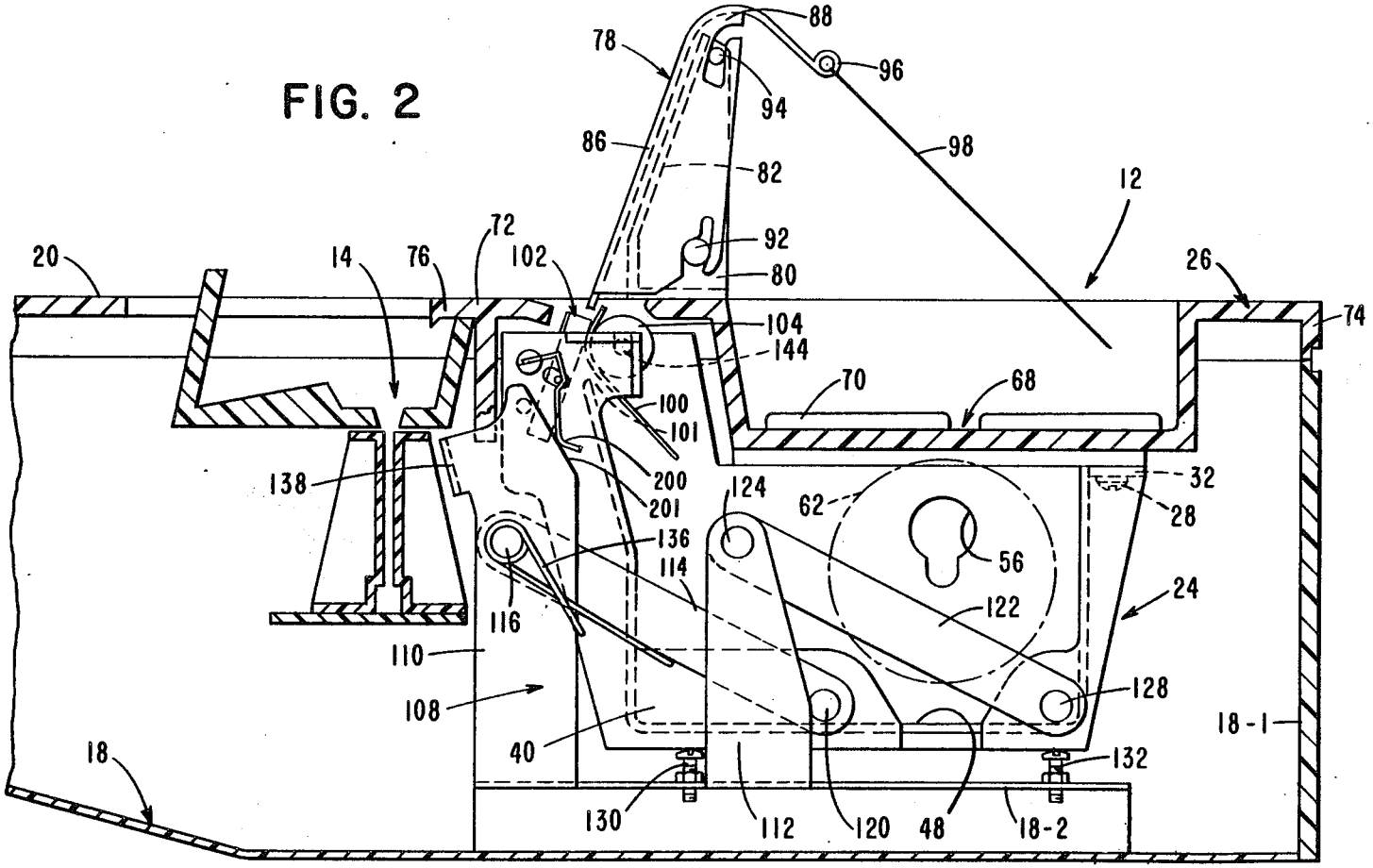
FIG. 2 is a general, cross-sectional view, taken approximately along the line 2—2 of FIG. 1, to show additional details of the printing apparatus while it is in the home or operating position.

FIG. 2 is a sectional view, taken approximately along the line 2—2 of FIG. 1 and shows the printing apparatus 12 in the home position or normal operating position from which printing is effected.

Figure 3:
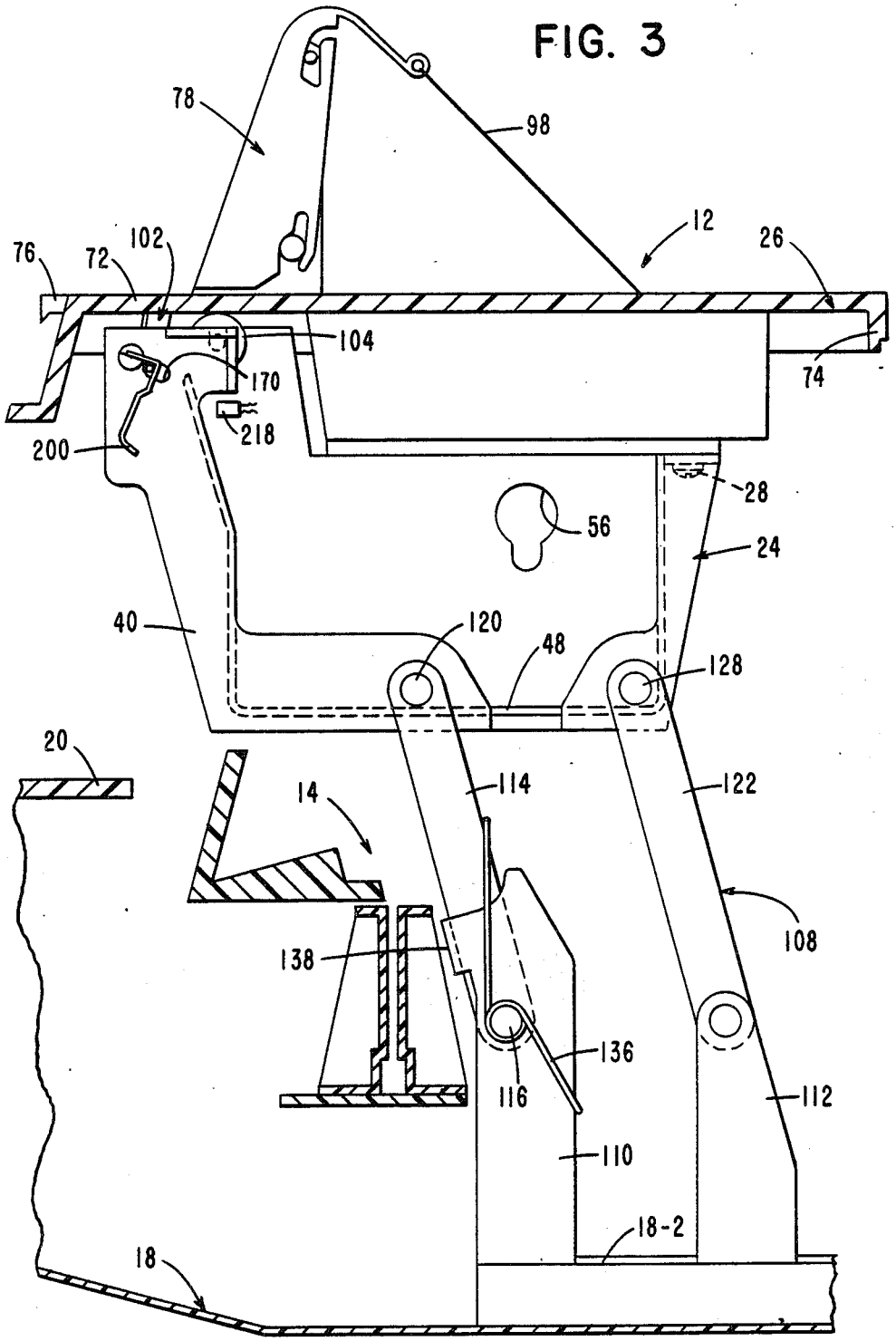
FIG. 3 is a view, similar to FIG. 2, showing the printing apparatus in a raised or accessing position to facilitate paper servicing and general repair.

FIG. 3 is a view similar to FIG. 2, but it shows the printing apparatus 12 in a second position or an accessing position from which record media such as fanfold paper or a roll of paper tape may be loaded or unloaded, for example.

Figure 4:
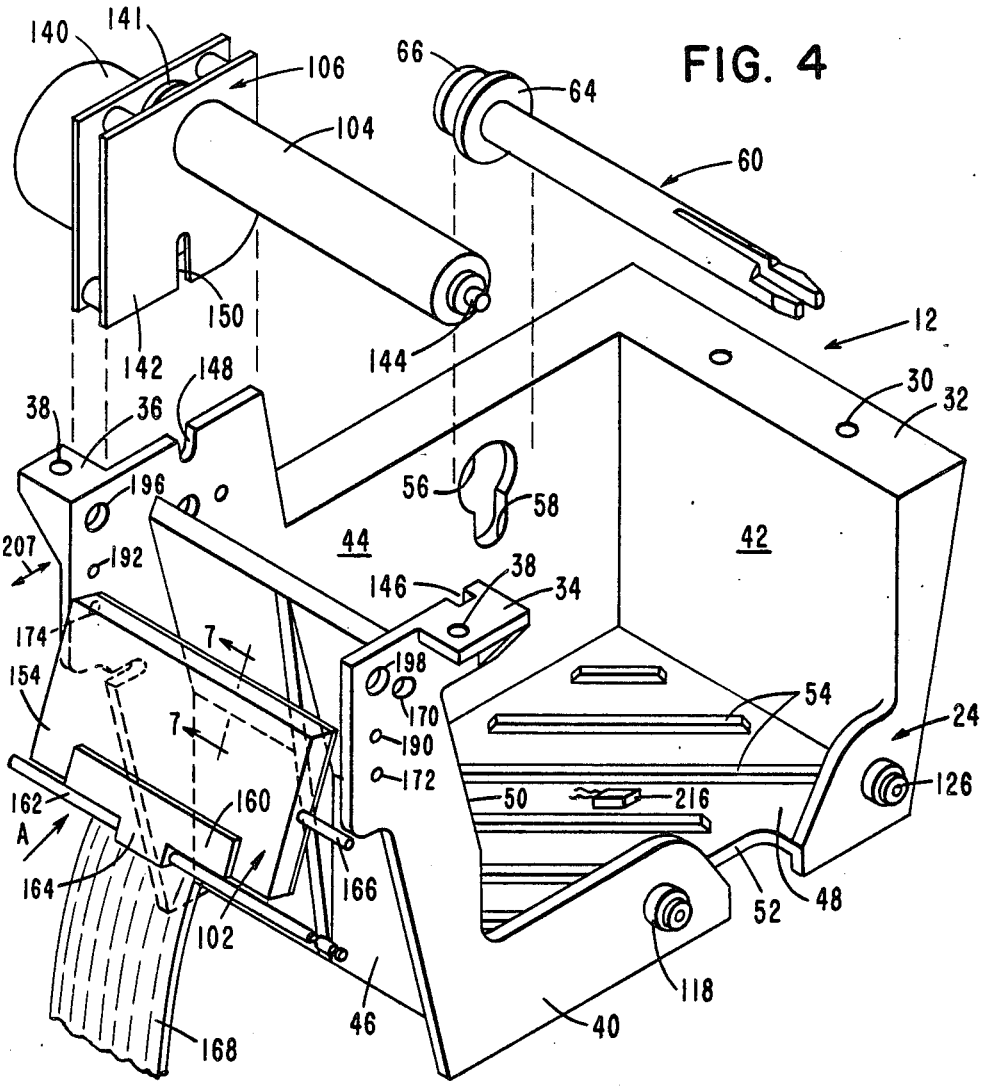
FIG. 4 is a general, exploded view, in perspective of a first portion of the support body shown in FIGS. 2 and 3, a thermal print head, and a platen advance mechanism.

FIG. 4 shows an exploded view, in perspective, of the printer apparatus 12, which figure in conjunction with FIGS. 2 and 3 will facilitate a description of the printing apparatus 12.

The printing apparatus 12 comprises a support means or a support body 22 (FIG. 5) including a lower or first portion 24 and an upper or a second portion 26 which portions are fastened together, for example, by fasteners 28 (FIG. 2) passing through holes 30 in a flange 32

(FIG. 4) of the first portion 24 and being secured to the second portion 26. Additional flanges 34 and 36 (FIG. 4), with holes 38 therein, enable screws (not shown) to pass therethrough to secure, additionally, the first and second portions 24 and 26 together.

The first portion 24 (FIG. 4) is generally box-like in shape, having walls 40, 42, 44 and 46 upstanding from a first area or floor 48. The wall 40 is cut away as at 50 to permit access to the interior of first portion 24, and the floor 48 is also cut away, as at 52, so as to facilitate the grasping of fanfold paper (not shown) which rests on the ribs 54 formed on the floor 48. The ribs 54 are optional. The wall 44 has an opening 56 and slot 58 therein to receive a conventional, detachable spindle 60 which is used to support a roll 62 of paper tape (shown in dashed outline in FIG. 2) within the first portion 24 when that type of media is used. The spindle 60 has spaced flanges 64 and 66 thereon to enable it to be detachably secured to the side wall 44. The flange 66 is simply inserted into the opening 56, and thereafter, the spindle 60 is pushed downwardly into the elongated slot 58.

Figure 5:
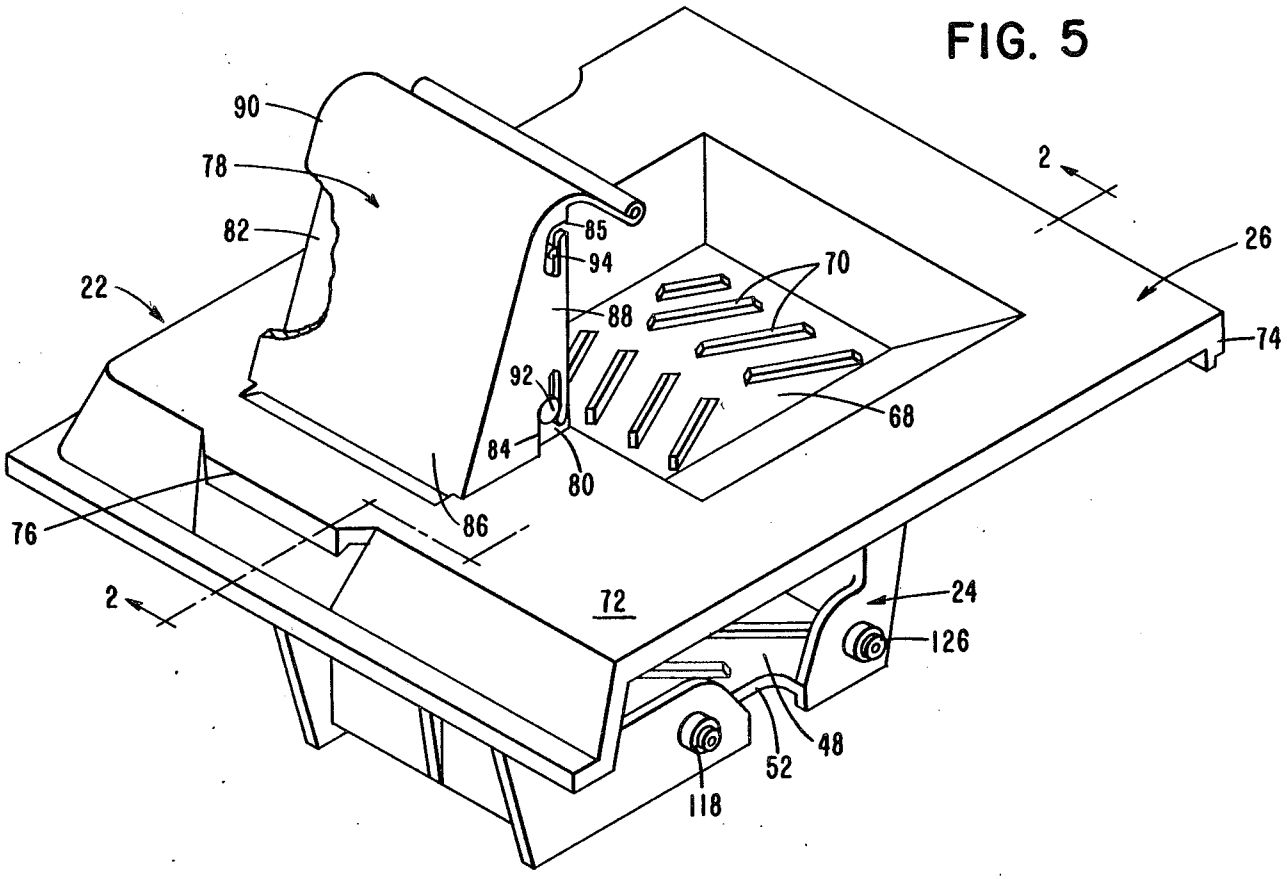
FIG. 5 is a general, perspective view of the first portion and a second portion of the support body of the printing apparatus in assembled relationship.

The top or second portion 26 of the support body 22 is shown best in FIG. 5. The second portion 26 has a well or paper-receiving area 68 formed therein, having ribs 70 formed thereon to facilitate the removal of paper therefrom. The paper-receiving area 68 is positioned above or superimposed over the first receiving area or floor 48. The second portion 26 also has a rectangular flange area 72 formed around the perimeter thereof, and this flange area 72 lies in the reference plane 20 when the printing apparatus 12 is in the home position shown in FIG. 2. The second portion 26 also has a flange 74 depending therefrom to enable the printing apparatus 12 to be flush with the back panel 18-1 (FIG. 2) of the frame 18. A lip 76, extending from the flange area 72 of the second portion 26, is used to facilitate lifting the printing apparatus 12 from the home position shown in FIG. 2 to the accessing position shown in FIG. 3.

The second portion 26 has a conventional paper support 78 thereon. The paper support 78 includes spaced uprights 80 (only one shown in FIG. 2) which may be detachably secured, conventionally, to the second portion 26 or integrally formed therewith to be upstanding therefrom. The spaced uprights 80 are connected by a planar area 82, best shown in the cutaway portion in FIG. 5. The paper support 78 also includes a front portion 86 and side portions 88 and 90 formed as a unit. The side portions like 88 have slots like 84 and 85 therein to accommodate short pins 92 and 94 extending from the spaced upright 80 to enable the unit formed of side portions 88 and 90 and front portion 86 to be detachably secured, conventionally, to the second portion 26. The front portion 86 is transparent and extends to the terminal end 96 (FIG. 2) thereof where a rectangular flat area or flap 98 is pivotally joined thereto. The flap 98 facilitates the folding of the fanfold paper and also helps to keep the paper in the receiving area 68.

A strip of paper 100 (FIG. 2), whether fanfold or roll type, passes through an open area 101 in the first portion 24, between the print head designated generally as 102 and the platen 104 of the platen advance mechanism 106 and also passes between the transparent front portion 86 and planar area 82 of the paper support 78, and then empties into the paper receiving area 68. In the embodiment described, the paper 100 is thermally responsive and is about four inches wide for both roll and fanfold types. When fanfold paper 100 is used, the fold length of the paper is typically six inches long.

One of the features of this invention is that the paper for the print head 102 can be loaded or unloaded while an operator sits at the keyboard 16. The means to enable the support body 22 to be moved from the home position shown in FIG. 2 to the raised or accessing position shown in FIG. 3 includes a parallel motion mechanism designated generally as 108. The mechanism 108 includes the spaced, stationary links 110 and 112 which are upstanding from a frame element 18-2 which is part of the frame 18. One end of a link 114 is pivotally joined to the stationary link 110 by a pin 116, and the remaining end thereof is pivotally joined to a boss 118, extending from the second portion 24 (FIG. 4) of the support body 22, by a fastener 120. Similarly, a second link 122 has one end thereof pivotally joined to the stationary link 112 by a pin 124, and the remaining end of link 122 is pivotally joined to the boss 126 (FIG. 4) by a fastener 128. The parallel motion mechanism 108, just described, is duplicated on the opposite side of the first portion 24 of the support body 22; however, it is not shown in order to simplify the drawing. There are adjustment screws like 130 and 132 (FIG. 2) which are mounted in the frame support 18-2 and which are used to provide adjustment for the apparatus 12 so that its flange area 72 may lie in the reference plane 20 to present a flush appearance to the machine 10.

In order to raise the apparatus 12 from the position shown in FIG. 2 to the position shown in FIG. 3, it is necessary to raise the apparatus 12 only by the lip 76. A torsion-type spring 136, wrapped around the pin 116 and cooperating with the stationary link 110 and the movable link 114, is used to provide a bias on the printing apparatus 12 to urge it towards the position shown in FIG. 3. As the printing apparatus 12 is raised from the position shown in FIG. 2, it is moved, slightly, to the right (as viewed in FIG. 2), and then it begins to move to the left (after passing a dead-center position), which brings the apparatus 12 towards the keyboard 16 as it approaches the accessing position shown in FIG. 3. The apparatus 12 is retained in the position shown in FIG. 3 by having the link 114 abut against a flange-type stop 138 which is formed on the stationary link 110. From the position shown in FIG. 3, the apparatus 12 can be accessed for paper servicing or for maintenance or easy replacement of the print head 102. To lower the apparatus 12, it is simply pushed downwardly and slightly to the right as viewed in FIG. 3. When the apparatus 12 passes the dead center position mentioned and rests on the screws 130 and 132, the weight of the apparatus 12 is sufficient to overcome the bias of spring 136 urging it upwardly.

Earlier herein, it was also stated that the apparatus 12 includes a low-cost printer which can be easily maintained. In this regard, the printer includes the platen advance mechanism 106 and the print head 102 already alluded to and shown best in FIG. 4.

The platen advance mechanism 106 (FIG. 4) includes a stepping motor 140 which is mounted on a frame 142 which includes any necessary conventional gearing 141 to rotate the shaft 144 in a clockwise direction as viewed in FIG. 4. The elastomeric platen 104 is formed on the shaft 144. The walls 40 and 44 of the first portion 24 have elongated slots 146 and 148, respectively, formed therein to receive the shaft 144. The frame 142 also has an elongated slot 150 therein to cooperate with a rib 152 (FIG. 6) on the wall 44 to mount and locate the platen advance mechanism 106 on the first portion 24 when the frame 142 is pushed on to the rib 152. The second portion 26 covers the slots 146 and 148 to retain the shaft 144 therein when the support body 22 is assembled as shown in FIG. 2, for example.

Figure 7:
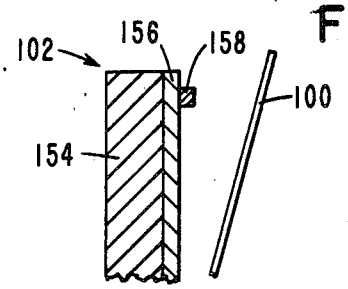
FIG. 7 is a cross-sectional view, taken along the line 7—7 of FIG. 4, to show additional details of a portion of the print head shown therein.

In the embodiment described, the print head 102 (FIG. 4) is of the thermal printing variety although other varieties may be used in the apparatus 12. The print head 102 includes an aluminum zinc substrate 154 (FIG. 7) having a thin ceramic layer 156 thereon. Individual heating elements 158 are positioned close to the top of the print head 102 (as viewed in FIG. 4) to permit the viewing of the last line printed, and they extend along the length of the platen 104 to effect line printing. A portion of each character to be printed on a line is generated across the length of the print head 102, and thereafter, the platen is indexed, incrementally, to print the next portion of each character to be printed across the line. In the embodiment described, the print head 102, in effect, prints a $5\times7$ matrix of dots for each character; however, the platen 104 is incrementally indexed seven times to incrementally advance the paper 100 to effect the complete printing of one line of characters.

The print head 102 (FIG. 4) has a mounting plate 160 secured thereto, and a mounting rod 162 passes through a short but thickened portion 164 of the plate 160 to enable the print head 102 to be mounted, pivotally, on the first portion 24 of the support body 22. The print head 102 also has a short rod 166 (FIG. 4) extending from one side thereof; this rod is used in pivotally moving the print head 102 away from the platen 104 to facilitate the loading of paper 100 therebetween, as will be described hereinafter. The print head 102 also has a flexible, flat, conductor cable 168 to operatively connect the heating elements 158 to a controller 222 to be later described herein.

Figure 6:
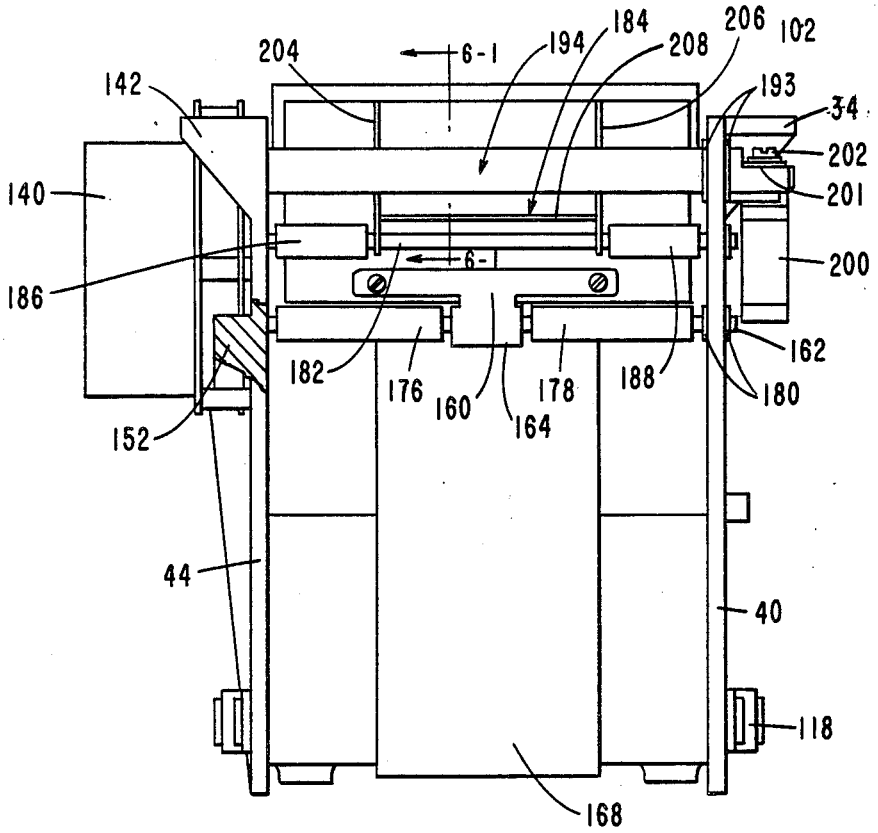
FIG. 6 is an elevational view of a portion of the apparatus of this invention as seen from the direction A of FIG. 4.
Figures 1, 6:
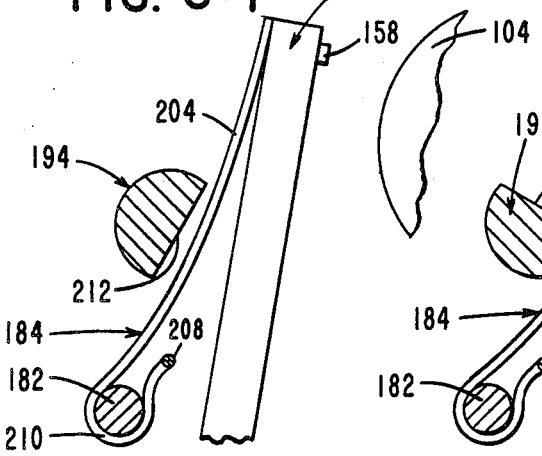
Figures 2, 6:
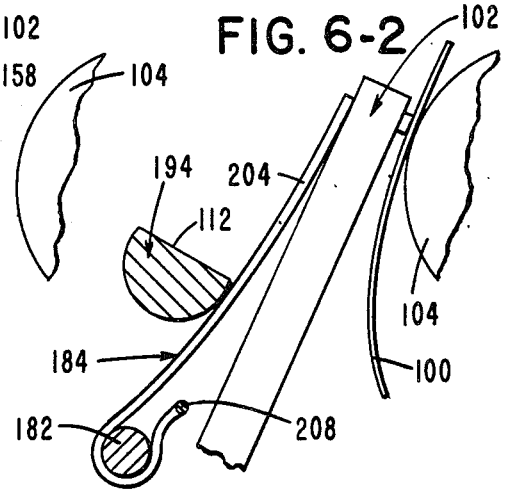

To mount the print head 102, the short rod 166 (FIG. 4) is inserted in the elongated slot 170 in wall 40 and the rod 162 is inserted in hole 172 in wall 40, and thereafter, the print head 102 is moved far enough to the right (as viewed in FIG. 4) to enable rod 162 to be inserted in hole 174 in wall 44. Suitable bushings 176 and 178 (FIG. 6) placed on the rod 162 prior to the insertion mentioned, center the print head 102, and suitable "C"-type washers, like 180, for example, cooperating with mating, annular recesses on the rod 162, prevent axial movement thereof. Another rod 182, having a spring 184 and spring-centering bushings 186 and 188 mounted thereon as shown in FIG. 6, is mounted in the holes 190 and 192 of the side walls 40 and 44, respectively, as shown in FIG. 4. And finally, a cylindrically-shaped cam 194 (FIG. 6) is mounted in suitable holes 196 and 198 in the side walls 44 and 40, respectively, (FIG. 4) and axially secured therein by "C" washers 193. The right side of the cam 194 has an end flat area 201 to which a camming lever 200 is secured by a fastener 202 (FIG. 6).

The spring 184 (FIG. 6) has leg portions 204 and 206 which are connected by a connecting portion 208, with a portion 210 of the leg portions 204 and 206 being bent, partially, around the rod 182 as shown in FIG. 6-1, for example, to secure the spring 184 to the rod 182.

The cam 194 has a flat portion 212 which is in the position shown in FIG. 6-1 when the camming lever 200 is in the position shown in FIG. 3. From this FIG. 3 position, the cam 194 does not bias the spring 184 against the print head 102, permitting it to be moved away from the platen 104. In the FIG. 3 position, the camming lever 200 also has moved the short rod 166 to the left side in the elongated slot 170 to move the print head 102 away from the platen 104 to permit the insertion of paper 100 therebetween. After the insertion of paper, the camming lever 200 is rotated counter clockwise from the position shown in FIG. 3 to rotate the cam 194 to the position shown in FIG. 6-2, from which the cam 194 forces the spring 184 against the print head 102 to bias it into operative engagement with the paper 100 and the platen 104.

The spring 184, with its legs 204 and 206 (FIG. 6), provides even pressure on the print head 102 across the length of the platen 104 to provide even printing therealong. The short portion 164 of the plate 160 is slightly, loosely fitted on the rod 162 to permit the print head 102 to pivot slightly in the directions of double arrow 207 (FIG. 4) to thereby enable the leg portions 204 and 206 of the spring 184 to apply the even pressure mentioned. If an operator forgets to rotate the camming lever 200 to bring the print head 102 into operative engagement with the paper 100 prior to lowering the apparatus 12, the camming lever 200 will engage a camming surface 201 (FIG. 2) on the stationary link 110 as the printing apparatus 12 is lowered to the position shown in FIG. 2 to effect such operative engagement.

The printing apparatus 12 (FIG. 4) also includes a conventional, light-and-sensor combination 216 which is positioned on the floor 48 of the first portion 24 to detect an out-of-paper condition therein. A similar, light-and-sensor combination 218 positioned near the print head 102 (FIG. 3) detects when there is only about one inch of paper left to be printed upon when the end of the paper passses thereby.

Figure 8:
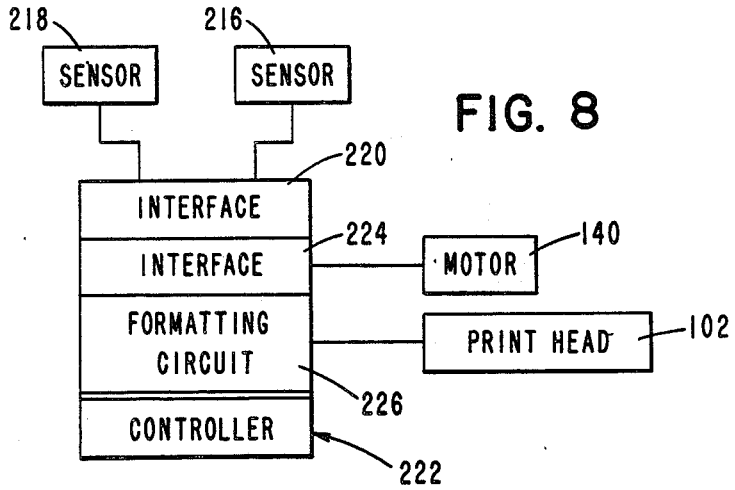
FIG. 8 is a diagram in block form showing a controller used with the apparatus of this invention.

Sensor 218 is connected through an interface 220 (FIG. 8) to enable the controller 222 to shut off the energizing currents to the print head 102 and thereby prevent damage (due to overheating) to it when no paper 100 is present. The sensor 216 is also connected through interface 220 to the controller 222. A suitable interface 224 couples the controller 222 to the motor 140 and a conventional formatting circuit 226 provides the appropriate energization to the heating elements 158 to effect the thermal, line printing as previously described. The controller 222 is conventional and may include a microprocessor with associated memory (not shown) and operating instructions to effect the control described.

Some miscellaneous comments appear in order. The first portion 24 of the support body 22, in the embodiment described, is made of a polycarbonate plastic material with no glass particles therein to minimize wear on the platen shaft 144 which is mounted therein. The second portion 26 is made of structural foam plastic to provide lightness while providing strength thereto. The printing apparatus 12 is quiet in operation, and in the embodiment described, prints 340 lines per minute. The only moving part in the printer apparatus 12 is the platen advance mechanism 106 which provides a simple, low-cost construction which is easy to repair or replace.

We claim:

1. A printing apparatus comprising:

a support body;

a printer;

said support body having a first area for storing media to be supplied to said printer and a second area for receiving media from said printer;

mounting means for mounting said printer on said support body to enable said printer to be moved as a unit with said support body; and moving means coupled to said support body to enable said support body to be moved from a home position to an accessing position located above said home position where the accessing of media in said support body is facilitated.

2. The apparatus as claimed in claim 1 in which said support body includes: a first portion having said first area therein; a second portion having said second area therein; and fastening means for securing said first and second portions together.

3. The apparatus as claimed in claim 2 in which said first area of said first portion is flat to receive fanfold media and said first portion also has a sidewall having support means therein for supporting thereon a roll-type said media.

4. The apparatus as claimed in claim 2 in which said printer comprises:

a print head;

a platen advance mechanism;

first means for pivotally mounting said print head in said first portion and second means for mounting said platen advance mechanism in said first portion; and third means for resiliently biasing said print head in operative engagement with said platen advance mechanism.

5. A printing apparatus comprising:

a support body;

a printer;

said support body having a first area for storing media to be supplied to said printer and a second area for receiving media from said printer;

mounting means for mounting said printer on said support body to enable said printer to be moved as a unit with said support body; and moving means coupled to said support body to enable said support body to be moved from a home position to an accessing position where the accessing of media in said support body is facilitated;

said support body including: a first portion having said first area therein; a second portion having said second area therein; and fastening means for securing said first and second portions together; and said moving means comprising: a frame having a reference plane associated therewith; link means coupling said support body with said frame to enable said support body to lie substantially close to said reference plane when said support body is in said home position, and to enable said support body to be moved to said accessing position where said support body is located more distantly from said reference plane than it is when said support body is in said home position.

6. The apparatus as claimed in claim 5 in which said link means includes a parallel motion mechanism.

7. The apparatus as claimed in claim 6 in which said parallel motion mechanism comprises a fourbar mechanism and biasing means for biasing said support body to move from said home position to said accessing position.

8. The apparatus as claimed in claim 5 in which said frame has a front area and a rear area with said support body being located near said rear area when in said home position and being located above said reference plane and towards said front area when said support body is in said accessing position to enable an operator situated near said front area to gain access to said media in said support body.

9. A printing apparatus comprising:

a support body;

a printer;

said support body having a first area for storing media to be supplied to said printer and a second area for receiving media from said printer;

mounting means for mounting said printer on said support body to enable said printer to be moved as a unit with said support body; and moving means coupled to said support body to enable said support body to be moved from a home position to an accessing position where the accessing of media in said support body is facilitated;

said support body including: a first portion having said first area therein; a second portion having said second area therein; and fastening means for securing said first and second portions together;

said printer comprising:

a print head;

a platen advance mechanism;

first means for pivotally mounting said print head in said first portion and second means for mounting said platen advance mechanism in said first portion; and third means for resiliently biasing said print head in operative engagement with said print head;

said third means including a spring and a cam lever attached thereto, said cam lever being mounted on said first portion and being movable between open and closed positions therein, said cam lever, when in said open position being effective to move said print head into an inoperative position with respect to said platen advance mechanism; said cam lever, when in said closed position, being effective to move said cam against said spring to bias said print head into operative engagement with said platen advance mechanism.

10. The apparatus as claimed in claim 9 in which said third means also comprises a camming surface on said moving means to cooperate with said camming lever to move said camming lever into said closed position as said support body is moved from said accessing position to said home position.

11. The apparatus as claimed in claim 10 in which said printer is a thermal print head and said media is of the fanfold type.

12. The apparatus as claimed in claim 11 in which said first and second areas are in superimposed relationship.

* * * * *

UNITED STATES PATENT AND TRADEMARK OFFICE

CERTIFICATE OF CORRECTION

PATENT NO. : 4,681,468

DATED : July 21, 1987

INVENTOR(S) : Fredrik L. N. Kallin et al.

It is certified that error appears in the above—identified patent and that said Letters Patent is hereby corrected as shown below:

Column 8, line 38, after "cam" insert --having a cam--.

Signed and Sealed this

Third Day of November, 1987

*Attest:*

*Attesting Officer*

DONALD J. QUIGG

*Commissioner of Patents and Trademarks*